United States Patent [19]

Jakobsson et al.

[11] 4,250,947

[45] Feb. 17, 1981

[54] GAS CONCRETE MOLD RUNNER AND METHOD OF USE

[75] Inventors: Per Jakobsson; Ingemar Larsson, both of Örebro, Sweden

[73] Assignee: Intong Aktiebolag, Kumla, Sweden

[21] Appl. No.: 898,167

[22] Filed: Apr. 20, 1978

[30] Foreign Application Priority Data

Apr. 28, 1977 [SE] Sweden ..... 7704889

[51] Int. Cl.[3] ..... B22C 1/02; B22C 9/08

[52] U.S. Cl. ..... 164/138; 106/38.3; 164/33; 164/41; 164/349

[58] Field of Search ..... 164/41, 138, 361, 33; 106/38.3

[56] References Cited

U.S. PATENT DOCUMENTS 3,099,052 7/1963 Suzuki et al. ..... 164/361 X

FOREIGN PATENT DOCUMENTS 51-26619 3/1976 Japan ..... 164/41
51-26621 3/1976 Japan ..... 164/41
51-26622 3/1976 Japan ..... 164/41
635959 4/1950 United Kingdom ..... 164/138

*Primary Examiner*—R. L. Spruill
*Assistant Examiner*—Gus T. Hampilos
*Attorney, Agent, or Firm*—Larson, Taylor and Hinds

[57] ABSTRACT

A method and an apparatus is provided for casting molten metallic materials through runners in the form of casting gates, flow-through tubes, feeders, rising gates and the like. The method basically comprises casting the molten metals through runners defined by bodies of porous calcium hydro-silicate such as gas concrete. A filler, such as quartz, may be used. The runner bodies are formed of gas concrete and provided with a moisture ratio of 3 to 30% so as to afford progressive evaporation of the moisture during casting to thereby produce a cooling effect on the runner walls. The runner bodies can be reinforced.

5 Claims, No Drawings

GAS CONCRETE MOLD RUNNER AND METHOD OF USE

FIELD OF THE INVENTION

The invention relates to a method for casting molten metallic materials through runners in the form of casting gates, flow-through tubes, feeders, rising gates and the like. The metallic materials to be casted may be ferro-alloys as well as non-ferrous alloys in the form of heavy or light metals.

BACKGROUND OF THE INVENTION

In iron and metal foundries as well as in steel foundries, some form of runner is generally used when casting the molten materials in the casting mold and chill mold, respectively. In iron and metal foundries, a casting mold is usually built up of a molding mass comprising, for example, sand, a binding agent and soot, and applied in a frame or box or cast iron or steel, i.e., a so-called "flask". The casting gate is, in the simplest case, shaped directly in the molding mass. However, for higher quality castings, special runners are arranged in the form of feeding sleeves and rising gates of a insulating material on top of the mold. This results in a better after-sinking with reduced shrinkage and better slag separation. When casting steel, the predominant casting method used presently is the so-called "bottom-casting" method, which provides for the steel to rise into the chill mold from below.

Casting of this type is characteristically done in a casting gate on a thick cast iron plate, the rising plane extending, for example, radially out from the lower end of the casting gate in grooves in the rising plane and from there up into the chill molds placed at the outer ends of the flow-through tubes.

Because the molten materials have a temperature during casting of approximately 1200° C. for heavy metal alloys and 1200°–1500° C. for ferro-alloys, the runners must be made of a material that can resist these temperatures at least during the casting period, which may last from about ten minutes up to roughly a half an hour.

At present, the feeding sleeves and rising gates of the iron and metal foundries are generally made of a tamping clay comprising a mixture of sand and oil gravel and thus are rather heavy and cumbersome so that some form of mechanical assistance is necessary to build and erect these sleeves and gates. This operation is usually carried out on the spot and is an activity which is specifically distinct from other foundry work, and, for this reason alone, an activity that foundries like to avoid. Further, the organic material contained in the tamping clay used in these sleeves and gates produces a heavy smoke formation which is presently one of the most serious environmental problems associated with foundries.

In steel foundries, the runners used are generally fabricated of ceramic materials in the form of chamotte, joined as a brickwork, and usually enclosed in cast iron casings and in grooves in the rising planes respectively. Dry sand is packed around the bricked-in tubes in order to support the brickwork and to prevent the molten material from running out and causing damage, as the chamotte easily cracks through temperature shock when coming into contact with the hot molten steel. The use of this dust-casting sand is another environmental problem because of the silicosis hazard for personnel. Further, because of the cracking characteristics of the chamotte, the steel ingots are prone to be contaminated by ceramic material which is carried along by the molten material and thereafter encased in the ingots.

It is characteristic of the methods used prior to the present invention that the preparation of the runners used therein requires considerable work and is quite expensive. Further, as explained above, the preparation and use of such runners present substantial environmental problems. Further, casting gates, feeders and rising gates have comparatively large connections to the casting and for this reason it is necessary to add a considerable excess of molten material to provide "tight" castings. The hardened excess is thereafter separated as waste. The problem of waste and the difficulties associated with separating the excess material are of long standing in the art.

SUMMARY OF THE INVENTION

In accordance with the invention, a method is provided which is a considerable improvement over, and simplification of, prior art methods of casting molten metallic materials through runners. The invention is characterized in that the molten materials are cast through runners formed by bodies of porous calcium hydro-silicate, with or without filler materials. The filler material used generally comprises unreacted quartz, although other inert filler materials, such as $Al_2O_3$, can be employed. The moisture ratio of the runner bodies is preferably 3 to 30% so as to provide for progressive evaporation of the water during casting, thereby resulting in cooling of the runner walls.

Other features and advantages of the invention will be set forth in, or apparent from, the detailed description of a preferred embodiment found hereinbelow.

DESCRIPTION OF THE PREFERRED EMBODIMENTS

The present invention is based in part on the discovery that casting through runners of porous calcium hydro-silicate can be carried out in spite of the fact that the temperature of the molten materials is sometimes higher than the fusing point of the runner material. It has been found that the inner surfaces of the runners sinter at the beginning of the casting operation to form smooth surfaces and a "lubricating" effect is achieved which facilitates the filling up of the mold. In contrast, in runners of sand or chamotte, the surface is rough and thus the friction is higher. Moreover, it has been found that by a variation of the calcium content when producing porous calcium hydro-silicate materials it is possible to control the relation between the binding agent and filler material in such a way that the fusing point of the material is influenced to a not inconsiderable extent.

A considerable improvement of the heat resistance of the runners is achieved by giving the porous calcium hydro-silicate material a selected moisture ratio. Ordinary gas concrete having a density of, for example, 400–600 kg/m3 has proved to be quite suitable for the method in accordance with the invention. In the state of equilibrium which is normally reached after storage for some years the moisture ratio of gas concrete is 4–5% by water, whereas this ratio is approximately 40% in newly produced material. If the gas concrete is given a moisture ratio of 3–30% using methods which are known per se, the material shows an astonishing resistance to different molten metals. It would generally appear strange to a foundry professional to work with runner material of such moisture ratios, as it is normally necessary to thoroughly dry the material used, i.e., sand, in order to avoid explosion dangers. However, when using gas concrete there does not appear to be any such danger. As high quantities of heat are released, the water in the pores evaporates and the partly sintered inner surface of the runner causes the water to pass through the pores on the outer sides of the runner. The steam then cools the wall material and the heat transmission slows down. Surprisingly enough, it has been found that this cooling does not cause cracking of the walls. The relationship of the moisture ratio to work in individual cases depends on, for example, the geometrical shape of the runners and other installation conditions which influence the capability of the moisture to evaporate outwardly.

Runners of porous calcium hydro-silicate material such as gas concrete can readily be prefabricated in whole pieces without joints and in required lengths and diameters, with and without reinforcement. Gas concrete is cast, e.g., in large blocks of up to 6 m length, and after being made porous and hardened to semi-plastic consistency, the blocks are separated by wire-sawing to suitable rectangular untis which are then steam-cured. In addition to reinforcements of various kinds, e.g., reinforcements in the form of net cylinders, suitable recesses for holes can be placed in the molds to form the runners. Further, after curing, the units can easily be shaped into runnners of different kinds and dimensions in view of the fact that gas concrete can be sawed, bored or milled much in the same way as wood.

Because of the excellent insulating properties of the porous calcium hydro-silicate material and the fact that the runners can be easily produced in one single piece, or a few pieces, without through-going cold bridges, the temperature of the molten material is kept high so that the mold is more thoroughly filled up. Consequently, the dimensions of, for example, the connections of the casting gates and the feeders and rising gates, respestively, to the casting, can be considerably smaller than with prior art arrangements. This reduction in dimensions is a considerable advantage because, as noted, the removal of the runner is a time-consuming as well as costly operation. The good insulating properties of the runners also mean that the quantity of molten material, and thus the amount of waste, can be considerably reduced. At the same time, minimum shrinkage and good slag separation are achieved. Thus, the building up of the casting system is simplified and made cheaper, and because of the low density of the material in relation to, for example, a ceramic material, the casting system is easy to handle. In addition, the environmental conditions in the foundry related to mold production are considerably improved, because the process involves no organic material which could cause smoke formation. Further, "knock out" of the casting is facilitated since no packing sand is necessary.

Although the invention has been described relative to exemplary embodiments thereof, it will be understood that other variations and modifications can be effected in these embodiments without departing from the scope and spirit of the invention.

We claim:

1. In a method for casting molten metallic materials through runners in the form of casting gates, flowing-through tubes, feeders, rising gates and the like, the improvement wherein the molten materials are cast using at least one runner defined by a body fabricated of gas concrete having a moisture content of 3 to 30% by weight, the surface of said body immediately surrounding said runner sintering in response to the temperature which occurs during passage of the molten metallic materials throught the runner and the fluid present in the pores of the gas concrete body vaporizing and passing outwardly through the body from said surface so as to provide cooling of the walls of said body, the density of said gas concrete body being in the range of from 400 to 600 kg/m$^3$.

2. A method according to claim 1, wherein said body comprises porous calcium hydro-silicate and includes a filler material.

3. A method according to claim 2 wherein said filler material comprises quartz.

4. A method according to claim 2 further comprising reinforcing of the porous calcium hydro-silicate body.

5. In casting apparatus for casting of molten metallic materials including a mold having a cavity therein and at least one runner defining member including at least one runner for conveying a charge of the material to be cast to the cavity of the mold, the improvement wherein said member is fabricated from solid gas concrete having a moisture content of 3 to 30% by weight and having a density in the range of from about 400 to 600 kg/m$^3$, the surface layer of said member immediately surrounding said runner sintering in response to the temperature rise during the passage of said charge simultaneously with the vaporization of the fluid present in the pores of said porous concrete member and the passage of the vaporized fluid out of said member away form said surface layer so as to provide cooling of the walls of said runner.

* * * * *